US012385164B2

(12) United States Patent
Chen et al.

(10) Patent No.: US 12,385,164 B2
(45) Date of Patent: Aug. 12, 2025

(54) WATER WASHING DEVICE FOR CARBON FIBER FILAMENT AND METHOD OF WATER WASHING

(71) Applicant: FORMOSA PLASTICS CORPORATION, Kaohsiung (TW)

(72) Inventors: Ching-Wen Chen, Kaohsiung (TW); Kun-Yeh Tsai, Kaohsiung (TW); Chia-Chi Hung, Kaohsiung (TW); Wen-Ju Chou, Kaohsiung (TW); Long-Tyan Hwang, Kaohsiung (TW)

(73) Assignee: FORMOSA PLASTICS CORPORATION, Kaohsiung (TW)

( * ) Notice: Subject to any disclaimer, the term of this patent is extended or adjusted under 35 U.S.C. 154(b) by 579 days.

(21) Appl. No.: 17/865,929

(22) Filed: Jul. 15, 2022

(65) Prior Publication Data

US 2023/0022309 A1 Jan. 26, 2023

(30) Foreign Application Priority Data

Jul. 16, 2021 (TW) ..... 110126336

(51) Int. Cl.

| | |
|---|---|
| ***D01D 10/06*** | (2006.01) |
| ***D01F 6/18*** | (2006.01) |
| *D06B 1/02* | (2006.01) |
| *D06B 21/00* | (2006.01) |
| *D06B 23/02* | (2006.01) |
| *D06B 23/14* | (2006.01) |
| *D06B 23/22* | (2006.01) |

(52) U.S. Cl.

CPC ..... *D01D 10/06* (2013.01); *D01F 6/18* (2013.01); *D06B 1/02* (2013.01); *D06B 21/00* (2013.01); *D06B 23/02* (2013.01); *D06B 23/14* (2013.01); *D06B 23/22* (2013.01); *D10B 2101/12* (2013.01)

(58) Field of Classification Search

CPC .. D01D 10/06; D01F 6/18; D01F 6/22; D06B 1/02; D06B 21/00; D06B 23/02; D06B 23/14; D06B 23/22; D10B 2101/12

See application file for complete search history.

(56) References Cited

U.S. PATENT DOCUMENTS 3,965,227 A * 6/1976 Stoy ..... C05C 9/00 264/37.22
9,796,590 B2 * 10/2017 Kiriyama ..... C01B 32/05

FOREIGN PATENT DOCUMENTS

| | | | |
|---|---|---|---|
| CN | 101979748 | A | 2/2011 |
| CN | 204080211 | U | 1/2015 |
| CN | 105624812 | A | 6/2016 |
| CN | 205295562 | U | 6/2016 |
| CN | 106435838 | A | 2/2017 |
| CN | 207017012 | U | 2/2018 |
| CN | 112126991 | A | 12/2020 |
| JP | 2003064573 | A | 3/2003 |

(Continued)

*Primary Examiner* — Erin F Bergner

(74) *Attorney, Agent, or Firm* — Muncy, Geissler, Olds & Lowe, P.C.

(57) ABSTRACT

A water washing device for carbon fiber filament and a method of water washing using the same are provided. The water washing device divides a temperature controller and the carbon fiber filament by disposing a division plate in a water washing tank; thus a temperature of washing water can be accurately controlled. Further, spray nozzle(s) can be controlled to enhance washing effect of the carbon fiber filament.

17 Claims, 1 Drawing Sheet

(56) References Cited

FOREIGN PATENT DOCUMENTS

| | | | |
|---|---|---|---|
| JP | 2004225195 | A | 8/2004 |
| JP | 2008-88616 | A | 4/2008 |
| TW | M622074 | U | 1/2022 |

* cited by examiner

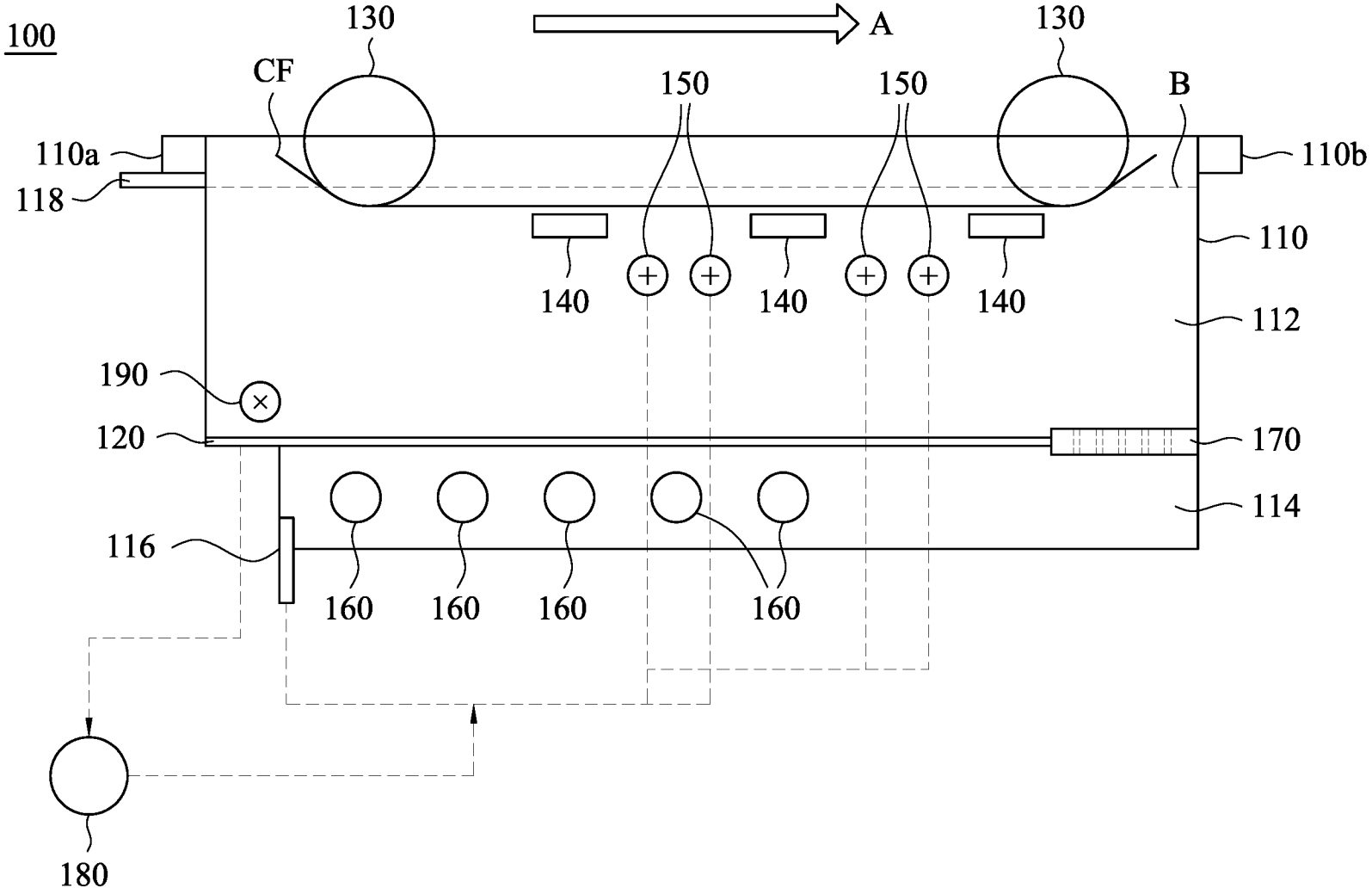
100
110a
118
110b
B
130
CF
130
A
150
150
140
140
140
110
112
170
114
190
120
116
160
160
160
160
180

WATER WASHING DEVICE FOR CARBON FIBER FILAMENT AND METHOD OF WATER WASHING

CROSS-REFERENCE TO RELATED APPLICATION

This application claims priority to Taiwan Application Serial Number 110126336, filed Jul. 16, 2021, which is herein incorporated by reference.

BACKGROUND

Field of Invention

The present invention relates to a water washing device for carbon fiber filament and a method of water washing. More particularly, the present invention relates to the water washing device for carbon fiber filament including spray nozzles and the method of water washing.

Description of Related Art

Carbon fiber is a fiber material with high strength, in which polyacrylnitrile (PAN)-based carbon fiber has the greatest market share. The PAN-based carbon fiber is formed from polyacrylnitrile fiber precursor. Production of the PAN fiber precursor includes processes of polymerization, filter, spinning, water washing, compacting drying, drawing, and etc. During the spinning process, a dope accesses a spinning solution through a spinneret during the spinning. However, there's a concentration difference between the dope and the spinning solution, so a solvent within the dope diffuse to the spinning solution, while water within the spinning solution penetrates to interior of the fiber through cortex of the as-spun fiber. During such double diffusion, the dope may coagulate to form the as-spun fiber. Since the as-spun fiber still includes solvent with specific concentration, the as-spun fiber should be introduced into the water washing device, thus performing a solvent washing process of surface and interior of the fiber.

During production of the PAN fiber precursor, water washing, which is an important step, and it is used to decrease residual solvent within the fiber. If the water washing effect is not significant, amount of residual solvent is high, and the fiber tends to fuse together between single fibers and cause defects such as hairiness and breaks. Moreover, abnormal production situation such as fused disconnect may also occur during a post-oxidation process, and when a carbon fiber composite is formed during post processing, problems such as nonuniform impregnation of resin, decreasing in physical properties and poor appearance of the carbon fiber composite result.

However, if consumption of washing water is increased for improving washing effect, consumption of steam and wastewater discharge may also increase correspondingly with increasing consumption of washing water, thus enormously increasing production cost.

Therefore, it is needed to provide a water washing device for carbon fiber filament; thereby washing effect of the fiber can be effectively improved without enormous consumption of washing water.

SUMMARY

An aspect of the present invention provides a water washing device for carbon fiber filament, which divides a temperature controller and the carbon fiber filament by disposing a division plate in a water washing tank; thus a temperature of washing water can be accurately controlled. Further, spray nozzle(s) can be controlled to enhance washing effect of the carbon fiber filament.

Another aspect of the present invention provides a method of water washing a carbon fiber filament, which performs water washing operation by using the water washing device of the above aspect.

According to the aspect of the present invention, providing the water washing device for carbon fiber filament, which includes plural of water washing tanks. The water washing tanks are disposed in series along a producing direction of the carbon fiber filament. Each of the water washing tanks includes a tank, a division plate, plural of driving rollers, plural of filament guides, at least a spray nozzle, a temperature controller, a perforated plate, and a pump. The tank is configured to accommodate washing water, in which the tank has an end of accessing filament and an end of exporting filament. The end of accessing filament has a water inlet and an overflow lip. The division plate is configured to divide the tank into an upper portion and a lower portion. The water inlet is disposed in the lower portion, and the overflow lip is disposed in the upper portion. The driving rollers are disposed in a top region of the upper portion, and the driving rollers are configured to move the carbon fiber filament. The filament guides are disposed in the upper portion and between the driving rollers. The carbon fiber filament is moved above the filament guides. The spray nozzle is disposed in the upper portion and between the end of accessing filament and the end of exporting filament. The spray nozzle is configured to spray water from underneath toward the carbon fiber filament. The temperature controller is disposed in the lower portion, and is configured to control a temperature of the washing water. The perforated plate is disposed at the end of accessing filament and connected to the division plate. The pump is connected to the tank and each of the at least a spray nozzle. The pump is configured to pump the washing water to each of the spray nozzle. The washing water flows from the water inlet into the tank through the temperature controller and the perforated plate, and further the washing water flows into the upper portion.

According to an embodiment of the present invention, each of the water washing tank includes a thermometer disposed in the upper portion and near the end of the accessing filament.

According to an embodiment of the present invention, each of the water washing tanks comprises 1 to 5 spray nozzle(s).

According to an embodiment of the present invention, a flowing direction of the washing water in the upper portion is contrary to the producing direction of the carbon fiber filament.

According to an embodiment of the present invention, the washing water flows from the overflowing lip of one of the water washing tanks to the water inlet of another one of the water washing tanks, and the end of accessing filament of the one of the water washing tanks is connected in series to the end of exporting filament of the another one of the water washing tanks.

According to an embodiment of the present invention, a distance between each of the at least a spray nozzle and the carbon fiber filament is in a range of 2 cm to 5 cm.

According to an embodiment of the present invention, a water spray rate of the at least a spray nozzle is in a range of 50 L/hr to 100 L/hr.

According to an embodiment of the present invention, a spray pressure of the at least a spray nozzle is in a range of 1 kg/cm$^2$ to 2 kg/cm$^2$.

According to an embodiment of the present invention, the pump is connected to the upper portion of the tank.

According to the another aspect of the present invention, the method of water washing a carbon fiber filament is provided, and the carbon fiber filament is introduced through the water washing device of the above aspect. The temperature of the water washing devices is gradually increasing along a producing direction of the carbon fiber filament.

According to the aspect of the present invention, providing the water washing device for carbon fiber filament, which includes plural of water washing tanks disposed in gradient. Each of the water washing tanks includes a tank, a division plate, plural of driving rollers, plural of spray nozzles, at least a temperature controller and a perforated plate. The tank is disposed to accommodate washing water. The carbon fiber filament accesses the tank from an end of accessing filament and exports the tank through an end of exporting filament. The division plate is disposed to divide the tank into an upper portion and a lower portion, in which a water inlet is disposed in the lower portion, and an overflow lip adjacent to the end of accessing filament is disposed in the upper portion. The driving rollers are disposed in the upper portion and between the end of accessing filament and the end of exporting filament. The driving rollers are disposed to move the carbon fiber filament. The spray nozzles are disposed in the upper portion and between the end of accessing filament and the end of exporting filament. The spray nozzles are disposed to spray water from underneath toward the carbon fiber filament. The at least a temperature controller is disposed in the lower portion. The at least a temperature controller is disposed to control a temperature of the washing water. The perforated plate is disposed at the end of accessing filament and connected to the division plate. The washing water flows from the water inlet into the tank through the temperature controller and the perforated plate and toward the upper portion, and a flowing direction of the washing water in the upper portion is contrary to a producing direction of the carbon fiber filament.

According to an embodiment of the present invention, each of the water washing tank further includes plural of filament guides disposed in the upper portion and between the driving rollers. The carbon fiber filament is moved above the filament guides.

According to an embodiment of the present invention, each of the water washing tanks comprises 3 to 5 the filament guides.

According to an embodiment of the present invention, each of the water washing tank further includes a pump connected to upper portion of the tank and each of the spray nozzles, in which the pump is disposed to pump the washing water to each of the spray nozzles.

According to an embodiment of the present invention, the perforated plate is disposed to flow the washing water from the lower portion to the upper portion.

According to an embodiment of the present invention, the at least a temperature controller controls a temperature of the washing water between 20° C. and 100° C.

According to an embodiment of the present invention, the washing water flows from the overflow lip of one of the water washing tanks to the water inlet of another one of the water washing tanks, and the end of accessing the filament of the one of the water washing tanks is connected in series to the end of exporting filament of the another one of the water washing tanks.

With an application of the water washing device for carbon fiber filament, the division plate is disposed in the water washing tank to divide the temperature controller and the carbon fiber filament; thus a temperature of washing water can be accurately controlled. Further, spray nozzle(s) can be controlled to enhance washing effect of the carbon fiber filament.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

The FIGURE is a diagram of a water washing tank according to some embodiments of the present invention.

DETAILED DESCRIPTION

According to above, the present invention provides a water washing device for carbon fiber filament and a method of water washing, which divides a temperature controller and carbon fiber filament by disposing a division plate in a water washing tank; thus a temperature of washing water can be accurately controlled. Further, spray nozzle(s) can be controlled to enhance washing effect of the carbon fiber filament.

The water washing device for carbon fiber filament provided by the present invention includes plural of water washing tanks disposed in series along a producing direction of the carbon fiber filament. The washing water is filled from the last water washing tank passed by the carbon fiber filament, and then flows through each of the water washing tanks in a direction contrary to the producing direction. In some embodiments, the water washing device includes 8 to 12 water washing tanks. In some embodiments, each water washing tank is disposed in gradient. In other words, height of the first water washing tank is the lowest, and then increase sequentially. Moreover, temperature in the water washing tanks is increasing gradually along a moving direction of the carbon fiber filament.

Referring to the FIGURE, which illustrates a diagram of a water washing tank 100 according to some embodiments of the present invention. The water washing tank 100 includes a tank 110 used to accommodate washing water. The tank 110 has an end of accessing filament 110*a* and an end of exporting filament 110*b*. It is noted that carbon fiber filament CF enters the water washing tank 100 along a producing direction A from the end of accessing filament 110*a*, and then depart from the water washing tank 100 by the end of exporting filament 110*b*. The tank 110 has a water inlet tube 116 corresponding to a water inlet and an overflow tube 118 corresponding to an overflow lip at a side of the end of accessing filament 110*a*. As described above, the washing water flows from the overflow tube 118 of the tank 100 may flow into the tank through the water inlet of the previous water washing tank, in which the end of accessing filament 110*a* is connected in series to the end of exporting filament 110*b* of the previous water washing tank. Moreover, the water inlet tube 116 of the last water washing tank may be used to supply washing water.

The water washing tank 100 further includes a division plate 120, which is disposed to divide the tank 110 into an upper portion 112 and a lower portion 114. Further, the division plate 120 connects to a perforated plate 170 at a side near the end of exporting filament 110*b*. The perforated plate 170 is disposed to flow the washing water from the lower portion 114 to the upper portion 112.

In some embodiments, the aforementioned water inlet tube 116 is disposed in the lower portion 114, and the overflow tube 118 is disposed in the upper portion 112. The water washing tank 100 has plural of driving rollers 130 in a top region of the upper portion 112, and the driving rollers 130 are disposed to guide the carbon fiber filament CF. Number of driving rollers changes according to size of the water washing tank 100. In some embodiments, 2 to 3 driving rollers 130 may be disposed. As shown in the FIGURE, for example, the driving rollers 130 may turn counter-clockwise to guide the carbon fiber filament CF moving toward the end of exporting filament 110*b*. It is noted that bottom position of the driving rollers 130 should be lower than water level B within the tank 110 so as to ensure that the carbon fiber filament CF is moved under water. Additionally, the carbon fiber filament CF still contacts air once entering and departing from the water washing tank 100.

The water washing tank 100 further includes filament guides 140 disposed between the driving rollers 130. When the carbon fiber filament CF goes through the water washing tank 100, it may be twisted after rinsing by spraying water. However, twist is disadvantageous to rinse of the carbon fiber filament CF, and it may cause overlapping between filament bundle of the carbon fiber filament CF. Therefore, the filament guides 140 are disposed below the carbon fiber filament CF, thereby separating individual carbon fiber filament CF, and further improving moving stability of the carbon fiber filament CF during water washing. In other words, the carbon fiber filament CF moves above the filament guide 140. Number of the filament guide 140 may change according to the size of the water washing tank 100. In some embodiments, 3 to 5 filament guides 140 are disposed. The filament guides 140 are all disposed below water level so as to ensure that the carbon fiber filament CF is moved under water.

In order to improve cleaning effect, the water washing tank 100 further includes at least a spray nozzle 150 disposed in the upper portion 112 and between the end of accessing filament 110*a* and the end of exporting filament 110*b*. In some embodiments, the spray nozzle(s) 150 is(are) disposed between the filament guides 140 and/or between the driving rollers 130 and the filament guides 140. The spray nozzle(s) 150 is(are) disposed to spray water from beneath toward the moving carbon fiber filament CF. However, number of spray nozzles may change according to the size of the water washing tanks 100. In some embodiments, a distance between the spray nozzle 150 and the carbon fiber filament CF is in a range of 2 cm to 5 cm. Within such distance range, the spray nozzle 150 may have better cleaning effect to the carbon fiber filament CF, and may not damage the filament bundle. In some embodiments, the spray nozzle 150 has a water spray rate in a range of 50 L/hr to 100 L/hr and spray pressure in a range of 1 kg/cm$^2$ to 2 kg/cm$^2$. The water spray rate and the spray pressure of the spray nozzle 150 are controlled to improve cleaning effect of the carbon fiber filament CF, and avoid causing the produced carbon fiber have defects such as hairiness due to spraying too strong water spout.

Typically, when temperature of the water in the water washing tank 100 is higher, diffusion velocity of solvent and water is faster, so the cleaning effect is better. However, if the carbon fiber filament CF directly enters the water washing tank 100 with high temperature, single fiber may form skin-core structure promptly, and it is disadvantageous to cleaning effect. Thus, water temperature of the water washing device should increase gradually from a coagulation tank of previous step, which is often between 20° C. and 100° C., and between 30° C. and 98° C. is preferable. Therefore, the water washing tank 100 of the present invention has a temperature controller 160 in the lower portion 114, which is disposed to control the temperature of washing water. In some embodiments, the temperature controller 160 uses steam and frozen water to control elevation and drop of temperature, respectively. In some embodiments, the washing water enters the lower portion 114 of the water washing tank 100 from the water inlet tube 116 then passes the temperature controller 160, thereby controlling the washing water to a desired temperature, and subsequently, the washing water flows to the upper portion 112 through the perforated plate 170 then outflow from the tank 110 through the overflow tube 118. Therefore, flowing direction of the washing water in the upper portion 112 is contrary to the producing direction A of the carbon fiber filament CF.

The water washing tank 100 further includes a pump 180, which connects the tank 110 to each spray nozzle 150 by pipe line. The washing water supplies to the pump 180 from the upper portion 112 of the tank 110, and pumps to the spray nozzle 150 to spray, thereby washing the carbon fiber filament CF. Since the washing water has flowed through the temperature controller 160, the water sprayed by the spray nozzle may not have problem of nonuniform washing temperature.

In some embodiments, the water washing tank 110 selectively includes a temperature meter 190, which is disposed in the upper portion 112 of the tank. In such embodiments, the temperature meter 190 prefers to dispose near the end of accessing filament 110*a*, thereby monitoring the temperature of washing water flowed to the pump 180.

The following Embodiments are provided to better elucidate the practice of the present invention and should not be interpreted in anyway as to limit the scope of same. Those skilled in the art will recognize that various modifications may be made while not departing from the spirit and scope of the invention.

Example 1

As-spun fiber produced after coagulating is first introduced to 4 sets of conventional impregnating compartment and then introduced to 2 sets of new water washing device of the present invention. Each new water washing device includes 2 water washing tanks connected in series, and each water washing tank includes 2 spraying unit, in which each spraying unit includes 2 spray nozzles disposed between the filament guides. The spray nozzles have the water spray rate of 100 L/hr and the spray pressure of 2 kg/cm$^2$. The distance between the spray nozzles and the as-spun fiber is 3 cm. The carbon fiber filament after washing is sampled to measure residual solvent, water washing efficiency and fused between single fiber, and results are shown in table 1.

Subsequently, the carbon fiber filament are drawn, oiled, compacting dried, and drawn by pressurized steam to obtain fiber precursor with single fiber fineness of 1 denier (d) and single fiber number of 3000 (total denier of 3000 d). Number of hairiness of produced fiber precursor is measured, and results are shown in table 1. It is noted that single fiber fineness is defined as weight in gram of fiber with length of 9000 m.

Then, the above fiber precursor is heated up from 240° C. to 280° C. in air atmosphere. A stabilization process is performed by controlling velocity ratio between front and back track roller to 1.0 for remaining fiber tension. Fiber density after stabilization process is 1.35 g/cm$^3$. Subsequently, the fiber is heated up gradually from 300° C. to 800° C. in nitrogen atmosphere, and a low-temperature carbonization is performed by controlling velocity ratio between front and back track roller to 0.9. Then, the temperature is increased gradually from 900° C. to 1800° C., and a high-temperature carbonization is performed by controlling velocity ratio between front and back track roller to 0.95. Afterwards, the fiber is introduced to acidic solution to perform electrolysis surface treatment, and the carbon fiber product may be formed after water washing, drying and starching. Strength and elongation of the carbon fiber product are measured, and results are shown in table 1.

Example 2 to 8

Example 2 to example 8 produce carbon fiber filaments and carbon fiber product by using the same producing equipment and method as example 1, but difference is that example 2 has the water spray rate of 50 L/hr and spray pressure of 1 kg/cm$^2$; example 3 has the distance between the spray nozzles and as-spun fiber of 5 cm; example 4 has each water washing tank with 3 sets of spraying unit; example 5 has each water washing tank with 1 set of spraying unit; example 6 has each water washing tank with 5 sets of spraying unit; example 7 has the water spray rate of 250 L/hr and spray pressure of 3.5 kg/cm$^2$; and example 8 has the distance between the spray nozzles and as-spun fiber of 0.5 cm.

Example 9 and 10

Example 9 has introduced the as-spun fiber produced after coagulating to 5 sets of the conventional impregnating compartment; while example 10 has introduced the as-spun fiber produced after coagulating to 8 sets of the conventional impregnating compartment. It is appreciated that the conventional impregnating compartments have no spray nozzles and division plates, so the as-spun fiber and temperature controller are not divided. In other words, the temperature controller and the as-spun fiber of the conventional impregnating compartments are on the same floor, so the temperature of the washing water is not uniform. The measurement results are shown in table 1.

Evaluation Method

Residual Solvent

After putting 5 g to 10 g of filament sample in a round-bottom flask to reflux under heat and extracted for 4 hours, it is static cool down, and then residual solvent weight W1 of the sample is measured by gas chromatography (SHIMADZU GC-2014-09). Subsequently, the extracted sample is dehydrated for 2 minutes by a dehydrator and then baked for 1.5 hours. After cooling down for 10 minutes, it is weighed and recorded weight W2. Thus, a ratio (W1/W2) of the residual solvent weight W1 and dry weight W2 of the sample multiplied by 100 is referred to residual solvent, and results are shown in table 1.

Washing Efficiency 10 g of as-spun fiber before accessing into the water washing device is taken to a centrifugal machine, and surface dehydration is performed by using a rotational speed of 3000 rpm. After centrifuging for 3 minutes, fiber weight W1 is recorded, in which weight W1 includes weight of the fiber and its internal water. Subsequently, the as-spun fiber is put in an oven with 105° C. to dry for 2 hours. After drying water, fiber weight W2 is recorded. Then, the as-spun fiber is put in a conical flask with 100 mL water added, and the above gas chromatography is used to measure a concentration of DMSO (solvent) within the conical flask, and recorded as $C_{GC}$. Therefore, the concentration of DMSO within the fiber before accessing into the water washing device ($C_{k\text{-}in}$) may be obtained by following formula (1).

$$C_{k\text{-}in}=C_{GC}\times(100+W1-W2)\div(W1-W2) \quad (1)$$

In addition, the carbon fiber filament obtained through the water washing device may follow the above steps to calculate the concentration of DMSO within the fiber after passing the water washing device ($C_{k\text{-}out}$). Then, the concentration of DMSO in the water washing tank ($C_w$) is measured by the gas chromatography. Thus, a washing efficiency (η) can be calculated by the following formula (2), and results are shown in table 1.

$$\eta=[1-(C_{k\text{-}out}-C_w)\div(C_{k\text{-}in}-C_w)]\times 100\% \quad (2)$$

Fusion Between Single Fibers

The carbon fiber filaments after water washing are sliced to about 3 mm by a single blade knife and then poured into a nonionic surfactant solution (0.1%). The solution with carbon fiber filament is dispersed and stirred for 1 minute with 60 rpm, and then dispersed on black filter paper to observe whether single fibers are fused together therebetween (i.e. the single fibers are stuck together due to fusion). The results are evaluated as level 1 to level 5, in which level 1 represents there is almost no fusion between the single fibers, while level 5 represents the fusion between the single fibers is serious. The evaluation results of fusion between single fibers are shown in table 1.

Hairiness

The moving fiber precursors after steam drawing are visibly observed, and an amount of hairiness generated is calculated after the fiber precursors is moved 1000 m, in which conditions are evaluated as level 1 to level 5. Evaluation standard is defined as: number of fiber precursors with hairiness≤1 is level 1; 1<number of fiber precursors with hairiness≤2 is level 2; 2<number of fiber precursors with hairiness≤5 is level 3; 5<number of fiber precursors with hairiness≤60 is level 4; number of fiber precursors with hairiness≥60 is level 5. The evaluation results of hairiness are shown in table 1.

Physical Properties of Carbon Fiber

The carbon fiber product is attached on a metal rack, and the carbon fiber is impregnated from top to bottom by resin. The carbon fiber bundle after impregnation is dried at 90° C. for 60 minutes and then hardening dried at 150° C. for 120 minutes, thus obtaining carbon fiber test pieces. The carbon fiber test pieces are used to measure strength and elongation by a tension testing machine (ZWICK ROELL Z005). The test results are shown in table 1.

TABLE 1

| | Residual solvent (ppm) | Washing efficiency (%) | Fusion together fibers between single | Hairiness | Physical properties Strength (MPa) | Elongation (%) |
|---|---|---|---|---|---|---|
| Example 1 | 102 | 65 | 1 | 1 | 5198 | 2.2 |
| Example 2 | 152 | 55 | 2 | 1 | 5023 | 2.12 |
| Example 3 | 116 | 63 | 1 | 1 | 5206 | 2.24 |

TABLE 1-continued

| | Residual solvent (ppm) | Washing efficiency (%) | Fusion together fibers between single | Hairiness | Physical properties Strength (MPa) | Physical properties Elongation (%) |
|---|---|---|---|---|---|---|
| Example 4 | 86 | 73 | 1 | 2 | 5079 | 2.16 |
| Example 5 | 353 | 42 | 3 | 4 | 4271 | 1.61 |
| Example 6 | 67 | 78 | 1 | 3 | 4478 | 1.79 |
| Example 7 | 85 | 73 | 1 | 3 | 4253 | 1.82 |
| Example 8 | 100 | 66 | 1 | 3 | 4125 | 1.77 |
| Example 9 | 1152 | 25 | 4 | 4 | 3789 | 1.52 |
| Example 10 | 519 | 33 | 3 | 4 | 4001 | 1.69 |

To ensure quality of the fiber and requirement of following oxidation and carbonization, residual solvent after water washing should be less than 200 ppm. According to table 1, example 1 to example 4 all have excellent washing effect and fiber evaluation, and the carbon fibers all have strength greater than 5000 MPa and elongation greater than 2%. Moreover, example 5 only used one set of spray unit; thus obviously, the washing effect is not as good as examples 1 to 4; similarly, evaluations of fusion together between single fibers and hairiness of example 5 are also worse. On the contrary, example 6 used 5 sets of spray unit, the washing effect is obviously increased, but evaluation of hairiness is bad. The reason is that the carbon fiber filament was excessively sprayed, thus causing amount of hairiness increase and further affecting the physical properties of the carbon fiber. Example 7 increased the water spray rate and the spray pressure, while example 8 shorten the distance between the spray nozzles and the carbon fiber filament, and both of which have similar results as example 6. Although the washing effect is great, the filament may be broken or the hairiness may occur due to too close distance or too strong water spout, thus doing bad effect on the carbon fiber. Example 9 and example 10 both did not use the new water washing device of the present invention; thus the washing effect is obviously worse, the evaluations of fusion together between single fibers and hairiness are bad, and further the strength and elongation of the carbon fibers are also bad.

According to the aforementioned examples, the new water washing device provided by the present invention can indeed have excellent washing effect to the carbon fiber filament. The evaluations of fusion together between single fibers and hairiness can be better while the condition of the spray nozzles are further controlled accurately; thus, the carbon fiber can have better physical properties.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A water washing device for carbon fiber filament, comprising:

a plurality of water washing tanks, wherein the water washing tanks are disposed in series along a producing direction of the carbon fiber filament, and each of the water washing tanks comprises:

a tank, configured to accommodate washing water, wherein the tank has an end of accessing filament and an end of exporting filament, and the end of accessing filament has a water inlet and an overflow lip;

a division plate, configured to divide the tank into an upper portion and a lower portion, wherein the water inlet is disposed in the lower portion, and the overflow lip is disposed in the upper portion;

a plurality of driving rollers, disposed in a top region of the upper portion, wherein the driving rollers are configured to move the carbon fiber filament;

a plurality of filament guides, disposed in the upper portion and between the driving rollers, wherein the carbon fiber filament is moved above the filament guides;

at least one spray nozzle, disposed in the upper portion and between the end of accessing filament and the end of exporting filament, wherein the at least one spray nozzle is configured to spray water from underneath toward the carbon fiber filament;

a temperature controller, disposed in the lower portion, wherein the temperature controller is configured to control a temperature of the washing water;

a perforated plate, disposed at the end of exporting filament and connected to the division plate; and a pump, connected to the tank and each of the at least one spray nozzle, wherein the pump is configured to pump the washing water to each of the at least one spray nozzle, wherein the tank is configured to flow the washing water from the water inlet into the tank through the temperature controller and the perforated plate, and further flows into the upper portion.

2. The water washing device of claim 1, wherein each of the water washing tank further comprises:

a thermometer, disposed in the upper portion and near the end of the accessing filament.

3. The water washing device of claim 1, wherein each of the water washing tanks comprises 1 to 5 spray nozzle(s).

4. The water washing device of claim 1, wherein a flowing direction of the washing water in the upper portion is contrary to the producing direction of the carbon fiber filament.

5. The water washing device of claim 1, wherein the washing water flows from the overflow lip of one of the water washing tanks to the water inlet of another one of the water washing tanks, and the end of accessing filament of the one of the water washing tanks is connected in series to the end of exporting filament of the another one of the water washing tanks.

6. The water washing device of claim 1, wherein a distance between each of the at least one spray nozzle and the carbon fiber filament is in a range of 2 cm to 5 cm.

7. The water washing device of claim 1, wherein a water spray rate of the at least one spray nozzle is in a range of 50 L/hr to 100 L/hr.

8. The water washing device of claim 1, wherein a spray pressure of the at least one spray nozzle is in a range of 1 $kg/cm^2$ to 2 $kg/cm^2$.

9. The water washing device of claim 1, wherein the pump is connected to the upper portion of the tank.

10. A method of water washing a carbon fiber filament, comprising: introducing the carbon fiber filament through the water washing device of claim 1, wherein temperature of the water washing devices is gradually increasing along the producing direction of the carbon fiber filament.

11. A water washing device for carbon fiber filament, comprising:

a plurality of water washing tanks, wherein the water washing tanks are disposed in gradient, and each of the water washing tanks comprises:

a tank, configured to accommodate washing water, wherein the carbon fiber filament accesses the tank from an end of accessing filament and exports the tank through an end of exporting filament;

a division plate, configured to divide the tank into an upper portion and a lower portion, wherein a water inlet is disposed in the lower portion, and an overflow lip adjacent to the end of accessing filament is disposed in the upper portion;

a plurality of driving rollers, disposed in the upper portion and between the end of accessing filament and the end of exporting filament, wherein the driving rollers are configured to move the carbon fiber filament;

a plurality of spray nozzles, disposed in the upper portion and between the end of accessing filament and the end of exporting filament, wherein the plurality of spray nozzles are configured to spray water from underneath toward the carbon fiber filament;

at least one temperature controller, disposed in the lower portion, wherein the at least one temperature controller is configured to control a temperature of the washing water; and a perforated plate, disposed at the end of exporting filament and connected to the division plate, wherein the tank is configured to flow the washing water from the water inlet into the tank through the at least one temperature controller and the perforated plate, and further flow into the upper portion, and a flowing direction of the washing water in the upper portion is contrary to a producing direction of the carbon fiber filament.

12. The water washing device of claim 11, wherein each of the water washing tank further comprises:

a plurality of filament guides, disposed in the upper portion and between the driving rollers, wherein the carbon fiber filament is moved above the filament guides.

13. The water washing device of claim 12, wherein each of the water washing tanks comprises 3 to 5 filament guides.

14. The water washing device of claim 11, wherein each of the water washing tank further comprises:

a pump, connected to upper portion of the tank and each of the spray nozzles, wherein the pump is disposed to pump the washing water to each of the spray nozzles.

15. The water washing device of claim 11, wherein the perforated plate is configured to allow the washing water to flow from the lower portion into the upper portion.

16. The water washing device of claim 11, wherein the at least one temperature controller controls a temperature of the washing water between 20° C. and 100° C.

17. The water washing device of claim 11, wherein the washing water flows from the overflow lip of one of the water washing tanks to the water inlet of another one of the water washing tanks, and the end of accessing the filament of the one of the water washing tanks is connected in series to the end of exporting filament of the another one of the water washing tanks.

* * * * *